US006537063B1

(12) United States Patent
Pecoskie

(10) Patent No.: US 6,537,063 B1
(45) Date of Patent: Mar. 25, 2003

(54) PORTABLE LAMP ASSEMBLY

(76) Inventor: Phil Pecoskie, 1643 Hillside Drive, London, Ontario (CA), N6G 2N3

( * ) Notice: Subject to any disclaimer, the term of this patent is extended or adjusted under 35 U.S.C. 154(b) by 0 days.

(21) Appl. No.: 10/012,174

(22) Filed: Nov. 26, 2001

(51) Int. Cl.[7] ..... F23D 3/18
(52) U.S. Cl. ..... 431/324; 431/320
(58) Field of Search ..... 431/320, 321, 431/322, 323, 324; 362/161, 163

(56) References Cited

U.S. PATENT DOCUMENTS 7,492 A * 7/1850 Jennings ..... 431/324
3,697,739 A * 10/1972 Novak et al. ..... 362/161
3,994,672 A * 11/1976 Novak ..... 431/320
4,025,290 A * 5/1977 Giangiulio ..... 431/324
4,494,926 A * 1/1985 Riha ..... 431/321
4,608,011 A * 8/1986 Comstock ..... 431/324
4,693,681 A * 9/1987 Comstock ..... 431/324
5,395,234 A * 3/1995 Gutierrez ..... 431/315
6,010,333 A * 1/2000 Tendick, Sr. ..... 431/324

* cited by examiner

*Primary Examiner*—Henry Bennett
*Assistant Examiner*—Alfred Basichas
(74) *Attorney, Agent, or Firm*—Eric Fincham

(57) ABSTRACT

A portable lamp assembly which comprises a fuel containing container and a globe therefore, the globe having a plurality of convex reflective surfaces on an inner surface thereof to maximize light output. The globe also functions as a protective member for the fuel containing container when in a stored position for transportation.

9 Claims, 3 Drawing Sheets

PORTABLE LAMP ASSEMBLY

FIELD OF THE INVENTION

The present invention relates to a lamp and more particularly, relates to a portable lamp utilizing a liquid fuel.

BACKGROUND OF THE INVENTION

Liquid fuel burners are known in the art and have been used for a number of years. They are generally considered to be a disposable item and have been used both for providing lighting and for warming foods in chafing dishes and the like. Typically, the burner includes a sealed container in which the fuel is stored and a wick that passes upwardly through the lid of the container. The fuel passes up through the wick and the wick is lit. When the fuel is exhausted, the container is typically discarded and replaced with a new unit.

Most disposable liquid fuel burners are relatively simple in structure and preset in the factory to provide for an optimum flame height by exposing a limited lamp wick above the top of the burner. The wick assembly, intended only for use with the single can, is relatively simple. One disadvantage of many of the disposable liquid fuel burners is the inherent danger in transporting the same. In many instances, it is desirable to transport the liquid fuel burner as, for example, when using the same on camping trips or the like. However, known liquid fuel burners generally are not designed for such use and particularly so when a relatively volatile fuel is utilized.

SUMMARY OF THE INVENTION

It is an object of the present invention to provide a disposable liquid fuel burner suitable for lighting purposes and which is compact in nature.

It is a further object of the present invention to provide a disposable liquid fuel burner for lighting purposes which is readily transportable.

In one embodiment of the present invention, there is provided a fuel burning assembly comprising a container designed to contain a fuel and a globe therefore, the container having a container side wall and a container top wall, the container top wall having an opening therein, an externally threaded neck surrounding the opening, the globe comprising a continuous globe side wall sized to fit externally of the container side wall, the globe side wall having an interior face and an exterior face and at least one member extending inwardly from the interior face and being arranged such that the member will rest on an upper portion of the container when the globe is placed over the container whereby the globe may function as a chimney.

The container having the liquid fuel therein, according to the present invention, is formed of a metallic material and is preferably cylindrical in configuration. Located centrally in the upper side wall is an aperture which is designed to receive a wick device. Surrounding the aperture is a neck, the neck preferably having external screw threads formed thereon to receive a cap. The top of the neck is designed to receive the wick assembly which will sit thereon.

The wick assembly includes the wick, which is preferably of a woven material, and a cover member, as previously mentioned, will include a flange which will seat on the top of the wall surrounding the aperture. Centrally of the cover member there will be a raised land portion with a lower portion surrounding the raised land portion. In the center of the raised land portion there will be provided an aperture for the wick to extend therethrough. The lower portion surrounding the raised land portion will include a drain back aperture formed therein such that any fuel thereon will drain back into the container.

In the preferred embodiment, there is also provided an intermediate cover member designed to cover a portion of the wick holder. In particular, the cover member may be designed to fit interiorly of the upstanding wall of the wick retainer and have a portion thereof designed to enclose the wick per se. In so doing, leakage during transportation is prevented.

There is also provided a chimney, the chimney serving two functions. During the transport, the fuel container is designed to fit within the chimney which provides additional protection therefore and also allows for a compact storage of the device. During the use, the chimney is designed to seat on the top of the fuel container and extend above the flame to provide protection for the flame. At the same time, a lower portion extends downwardly about the upper side wall of the container while still permitting a supply of air to the wick. Preferably the chimney is formed of a clear heat resistant material and more preferably of a heat resistant plastic material such as marketed under the trademark Lexan®. To maximize the lighting effect, the chimney is preferably given refractive properties and to this end, may comprise a cylindrical wall having beveled portions on the interior surface thereof.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
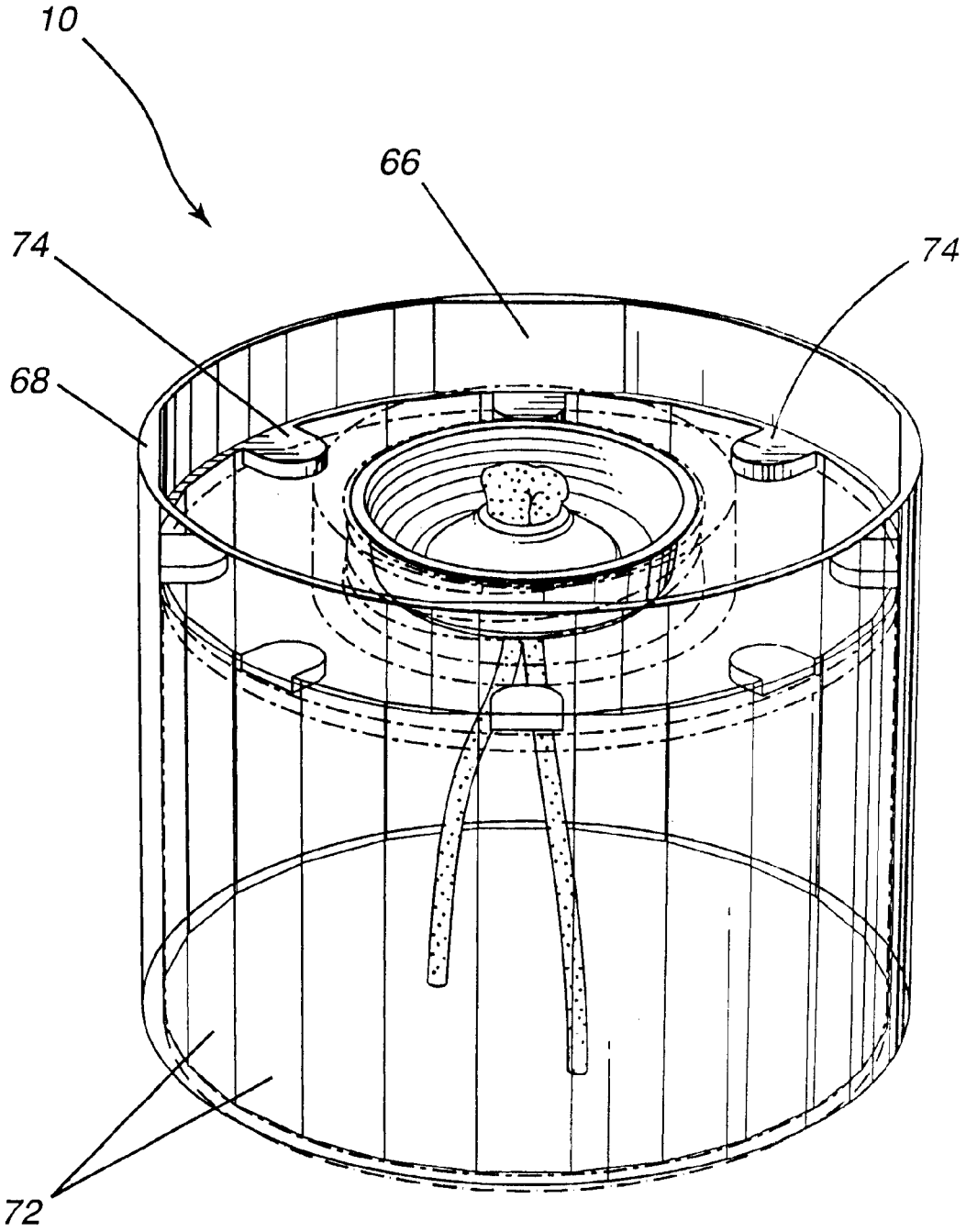
FIG. 1 is a perspective view of a fuel burning assembly according to one embodiment of the present invention.
Figure 2:
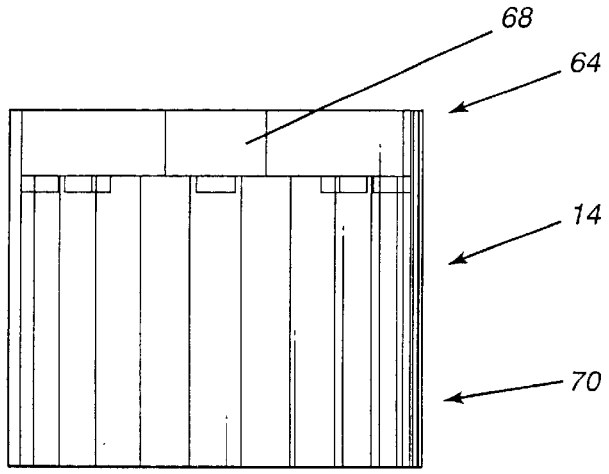
FIG. 2 is a side elevational view of the globe portion thereof.
Figure 3:
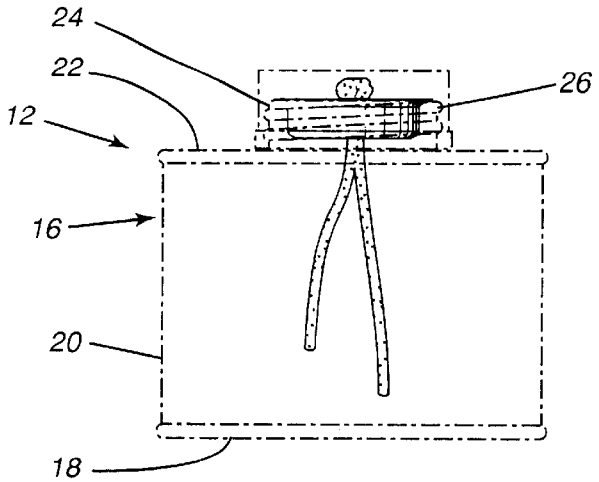
FIG. 3 is a cross sectional view of the fuel container portion thereof.
Figure 5:
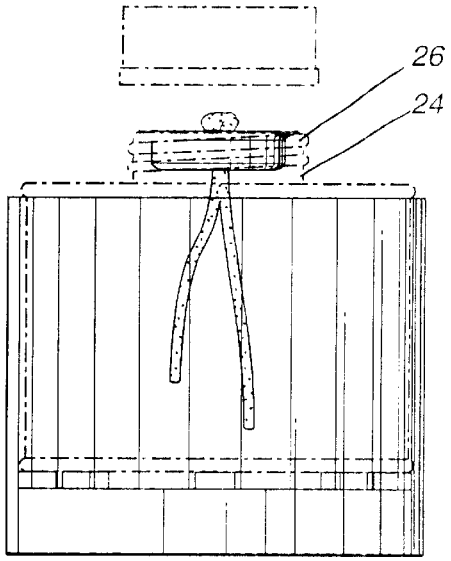
FIG. 5 is a cross sectional view thereof.
Figure 4:
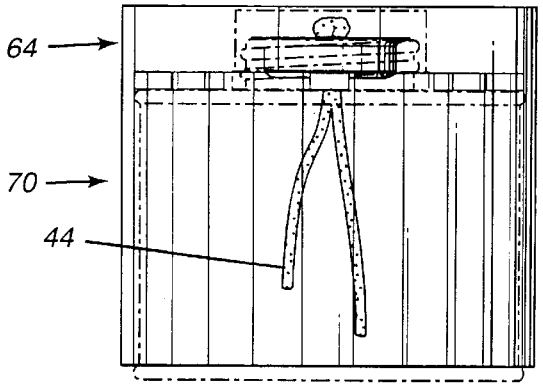
FIG. 4 is a side elevational view of the globe and fuel container in a storage position.
Figure 6:
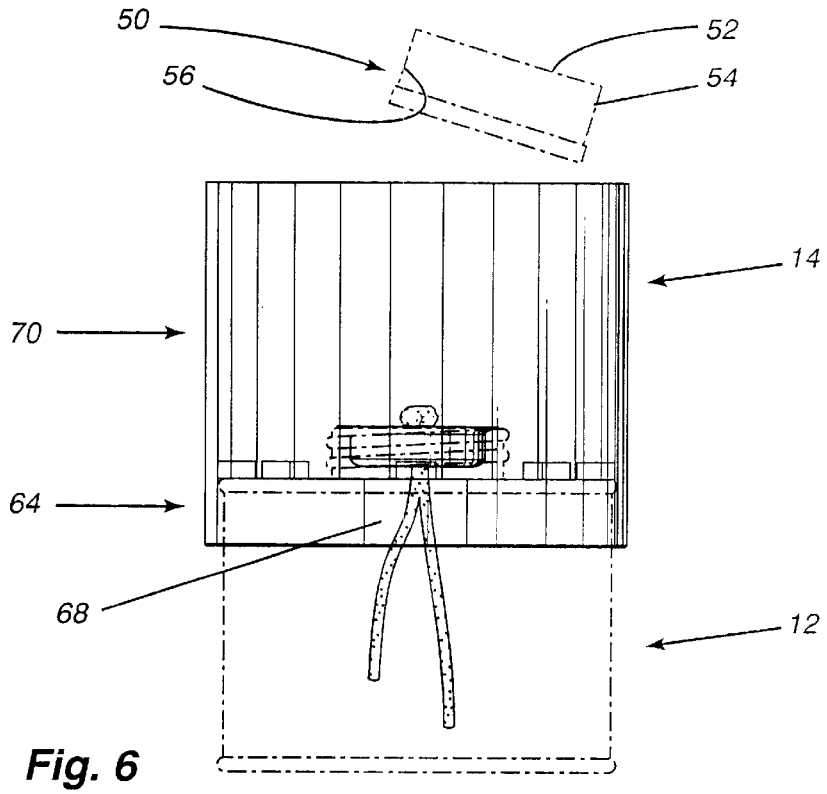
FIG. 6 is a side elevational view showing the fuel container and globe in an operative position.

Referring to the drawings in greater detail and by reference characters thereto, there is illustrated in FIG. 1 a fuel burning assembly generally designated by reference numeral 10 and which fuel burning assembly is designed to be used for lighting purposes.

Assembly 10 includes a fuel container generally designated by reference numeral 12 and a globe generally designated by reference numeral 14.

Fuel container 12 comprises a can 16 having a bottom wall 18, a side wall 20 and a top wall 22, the hole being formed in a conventional manner. Situated on top wall 22 and formed intrically therewith is a neck 24 having external threads 26 formed thereon.

Figure 7:
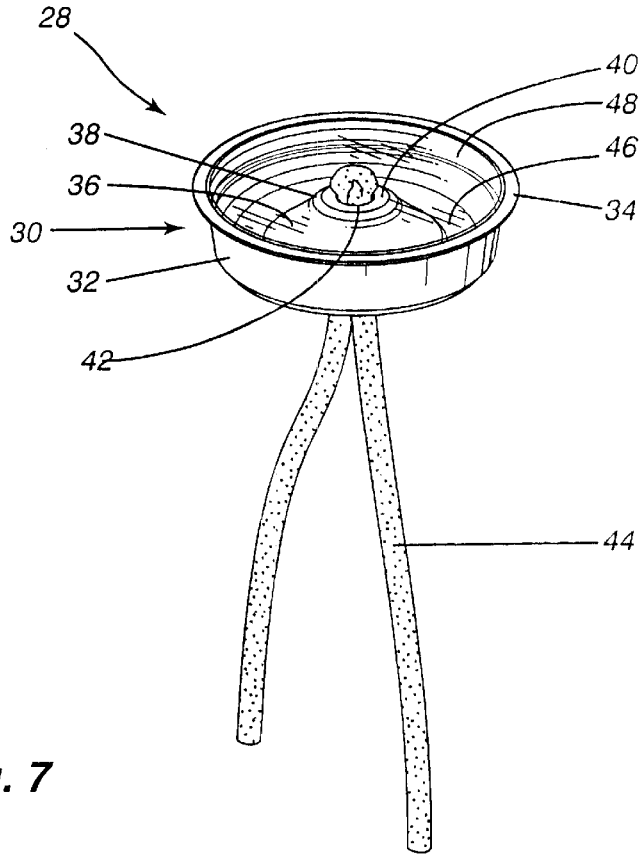
FIG. 7 is a perspective view of the wick and cap component of the fuel container.

Turning to FIG. 7, there is illustrated a wick assembly which is generally designated by reference numeral 28.

Wick assembly 28 includes an insert 30 sized to fit within neck 24. Insert 30 includes a side wall 32 having a flange 34 extending outwardly at the upper end thereon and designed to seat on the upper periphery of neck 24 of can 16. At the lower end of side wall 32 of insert 30, there is provided an upwardly sloping bottom wall 36. Located centrally of sloping bottom wall 36 is an inner side wall 38 which extends to an inner top wall 40 having a wick aperture 42 formed therein. Mounted in wick aperture 42 is a wick 44 designed to extend into can 16 and the fuel contained therein.

Formed within sloping bottom wall and located proximate to its point of joinder with side wall 32 are one or more drainage apertures 46 to permit drainage of any fuel back into can 16. A cap member 48 is sized to fit within insert 30 and to sealingly engage the same.

A cover member 50 includes a top wall 52 and a downwardly depending skirt or side wall 54 having internal threads 56 formed thereon and which internal threads are designed to meet with external threads 26 on neck 24.

Globe 14 is formed of a transparent material and may be conveniently formed of a transparent plastic material. Globe 14 includes a minor portion 64 having first and second bevel segments 66 and 68 formed therein. Thus, minor portion 64 is generally circular in configuration, both on the interior and exterior surface, except for bevel segments 66 which have a convex configuration on the inner surface thereof.

A major portion 70 of globe 14 has a plurality of equally configured bevel segments 72 formed thereon. Bevel segments 72 are formed on the interior surface of major portion 70 and comprise a plurality of concave configurations.

Separating minor portion 64 and major portion 70 are a plurality of inwardly extending tabs 74.

In use, the arrangement is such that minor portion 64 of globe 14 will fit over the upper portion of can 16 with tabs 74 sitting on the rim of can 16. Major portion 70 extends above can 16 and the beveled portions are designed to reflect the maximum amount of light. The arrangement is such that air may flow upwardly between minor portion 64 and can 16.

For transport purposes, the globe is inverted such that major portion 70 is in the lower position. The distance between tabs 74 and the marginal edge of major portion 70 is substantially equal to the height of can 16. In this configuration, minor portion 64 will extend above the neck 24 and cover 50. Globe 14 is also arranged such that there will be frictional engagement between the area of major portion 70 adjacent tabs 74 and the rim of can 16.

It will be understood that the above described embodiments are for purposes of illustration only and that changes or modifications may be made thereto without departing from the spirit and scope of the invention.

I claim:

1. A fuel burning assembly comprising a container designed to contain a fuel and a globe therefore;

said container having a container side wall and a container top wall;

said container top wall having an opening therein, an externally threaded neck surrounding said opening;

said globe comprising a continuous globe side wall sized to fit externally of said container side wall, said globe side wall having an interior face and an exterior face; and at least one member extending inwardly from said interior face and being arranged such that said member will rest on an upper portion of said container when said globe is placed over said container whereby said globe may function as a chimney.

2. The fuel burning assembly of claim 1 further including a wick assembly, said wick assembly including a wick and a wick holder, said wick holder being sized to fit within said opening in said container top wall and to seat on said externally threaded neck.

3. The fuel burning assembly of claim 1 wherein both said container side wall and said globe side wall have a generally cylindrical configuration.

4. The fuel burning assembly of claim 3 wherein said at least one member extending inwardly from said interior face comprises a plurality of spaced tabs extending inwardly from said interior face.

5. The fuel burning assembly of claim 3 wherein said globe side wall is sized and configured such that when said globe is placed over said container, an air space is provided between said container and said globe side wall to permit air flow therethrough.

6. The fuel burning assembly of claim 3 wherein said globe side wall has a slightly tapered configuration to snugly retain said container for transportation thereof.

7. The fuel burning assembly of claim 3 wherein said globe side wall has a height substantially equal to the height of said container.

8. The fuel burning assembly of claim 1 wherein said globe is constructed of a transparent plastic material.

9. The fuel burning assembly of claim 3 wherein said inner face of said globe side wall has a plurality of bevels to aid in light reflection.

* * * * *